United States Patent [19]

Nakada

[11] 3,973,543

[45] Aug. 10, 1976

[54] APPARATUS FOR PROMOTING A VAPORIZATION OF A FUEL FOR AN INTERNAL COMBUSTION ENGINE

[75] Inventor: Masahiko Nakada, Toyota, Japan

[73] Assignee: Toyota Jidosha Kogyo Kabushiki Kaisha, Toyota, Japan

[22] Filed: Apr. 5, 1974

[21] Appl. No.: 458,433

[30] Foreign Application Priority Data

Sept. 10, 1973 Japan ..... 48-101886

[52] U.S. Cl. ..... 123/141; 123/122 AC; 123/119 E

[51] Int. Cl.[2] ..... F02M 29/00

[58] Field of Search ..... 123/119 E, 122 AB, 122 F, 123/122 AC, 122 H, 141; 219/206, 207

[56] References Cited

UNITED STATES PATENTS

| | | | |
|---|---|---|---|
| 1,547,384 | 2/1925 | Gruenewold | 123/122 AC |
| 1,771,626 | 7/1930 | Hamilton | 123/119 E |
| 1,854,475 | 4/1932 | Littlefield | 123/119 E |
| 2,705,941 | 4/1955 | Unschuld | 123/119 E |
| 2,766,582 | 10/1956 | Smith | 123/119 E |
| 2,926,276 | 2/1960 | Moriya | 123/119 E |
| 3,266,783 | 8/1966 | Knight | 123/119 E |
| 3,349,354 | 10/1967 | Miyata | 123/119 E |
| 3,537,829 | 11/1970 | Ott | 123/119 E |
| 3,749,545 | 7/1973 | Velhoff | 123/119 E |
| 3,761,062 | 9/1973 | King | 123/119 E |

*Primary Examiner*—Charles J. Myhre
*Assistant Examiner*—R. H. Lazarus
*Attorney, Agent, or Firm*—Kenyon & Kenyon

[57] ABSTRACT

A vaporization promoting apparatus for an internal combustion engine is disclosed, in which at least one electrode is disposed in an intake manifold, and the electrode and the intake manifold are respectively connected to a high voltage generator which is provided for forming an intensive electric field in the interior of the intake manifold, thereby vaporization of a fuel injected into the intake manifold from a nozzle of a carburetor is promoted by the intensive electric field.

5 Claims, 3 Drawing Figures

APPARATUS FOR PROMOTING A VAPORIZATION OF A FUEL FOR AN INTERNAL COMBUSTION ENGINE

DESCRIPTION OF THE INVENTION

The present invention relates to an apparatus for promoting the vaporization of a fuel injected into the interior of an intake manifold of an internal combustion engine from a nozzle of a carburetor in such a manner that an intensive electric field is formed in the interior of the intake manifold.

When a conventional engine is started cold and then is warmed up, a choke mechanism of a carburetor is operated and thus a mixture having a richer air/fuel ratio than that of a mixture during ordinary operating conditions of the engine, is supplied to the cylinders of the engine.

This fact is described as follows. When the temperature of the atmosphere is relatively low and particularly when the temperature of an intake manifold of an engine is relatively low, only a small part of the fuel injected into the intake manifold from the nozzle of a carburetor is vaporized to form a mixture and a large part of the fuel is partially floated in said mixture as droplets while the rest of the fuel flows along an inner wall of the intake manifold as liquid fuel. However, when the temperature around the droplets and liquid fuel is relatively low, the droplets as well as the liquid fuel cannot sufficiently absorb heat from their surroundings and thus vaporization can not be sufficiently obtained. As a result, engines can not be easily started and further, the smooth operation of an engine can not be obtained as the appropriate combustion of the mixture is not effected in the cylinder of an engine after the starting of the engine. Consequently, in order to eliminate the above disadvantages, it is quite usual to supply the intake manifold with a mixture having a richer air/fuel ratio than that of a mixture during the ordinary operating conditions of the engine and to increase the actual amount of fuel which is vaporized in the intake manifold, so as to obtain an easy starting and a smoother rotation of the engine.

However, when a mixture having a richer air/fuel ratio, caused by operating the choke mechanism, than that of the mixture during ordinary operating conditions of an engine is supplied to the intake manifold, an appropriate easy start as well as appropriate smooth operation of the engine can not be obtained. Further, when an appropriate combustion of the mixture is not effected in the cylinders of an engine, a harmful component in exhaust gas is considerably increased and this factor contributes to air pollution.

Therefore, in order to promote a vaporization of the fuel which is injected into the intake manifold from the nozzle of the carburetor, various improvements have recently been tried. For example, in one of the improvements, cooling water which absorbs heat from the engine is routed to a heating portion formed on an outer surface of the intake manifold and the heat of said cooling water is transferred to the intake manifold so as to heat up said intake manifold. In another improvement, a part of the exhaust gas from the engine and having a high temperature is also routed to the above-mentioned heating portion and the heat of the exhaust gas is transferred to the intake manifold so as to heat up said intake manifold.

However, in the two above-mentioned improvements, there are disadvantages. For example, the construction of an engine often becomes more complicated and also, adapting these improvements to all types of engines is often difficult. There is a further disadvantage in that as the temperature of the heating portion of the intake manifold increases to a high temperature, the durability of the intake manifold is considerably reduced. A still further disadvantage is that the heat of the heating portion is transferred to the carburetor mounted on the above end of the intake manifold and the temperature of the carburetor increases because of the transferred heat, and thus, because of this additional heat the carburetor is prevented from normal metering of the fuel into the intake manifold.

The present inventor used the following phenomena, which had already been experimentally proven, when inventing the present invention. That is, when a high voltage is applied to a liquid, the velocity of vaporization of that liquid is considerably increased and the heat transferred to the liquid from the surroundings of the liquid is greatly increased.

An object of the present invention is to provide an apparatus for promoting the vaporization of the fuel in such a manner that an intensive electric field is formed in the interior of the intake manifold and the vaporization of fuel injected into the intake manifold from the nozzle of the carburetor is promoted according to the above-mentioned phenomena, thereby engines can be easily started and as an appropriate combustion is obtained after the engine starts, a smooth operation of the engine can be obtained and further the harmful component of exhaust gas can be reduced.

In a preferred embodiment according to the present invention, an apparatus for promoting vaporization of a fuel, comprises; at least one electrode disposed in an intake manifold of the internal combustion engine, and a high voltage generator which is connected with said electrode and is also connected with the intake manifold, said high voltage generator forming an intensive electric field in the interior of the intake manifold.

These and other objects of the invention may be more fully understood from the following description of a preferred embodiment of the invention, together with the accompanying drawings.

BRIEF DESCRIPTIONS OF THE DRAWINGS

DESCRIPTION OF A PREFERRED EMBODIMENT

Figure 1:
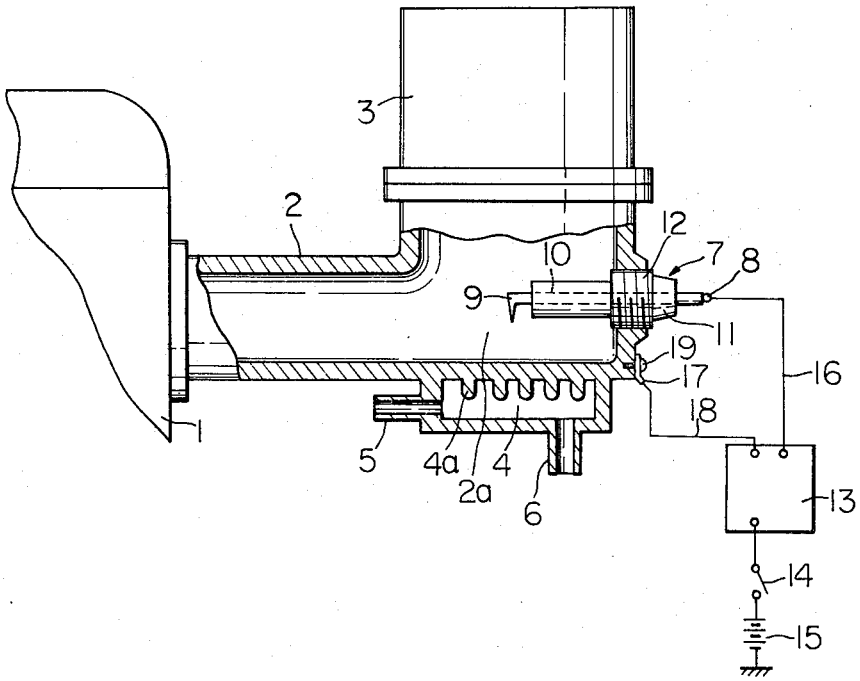
FIG. 1 is a side elevational view, partly in cross section, of an intake manifold including a vaporization promoting apparatus according to the present invention.

Referring to FIG. 1, a vaporization promoting apparatus of the present invention comprises an intake manifold 2, an electrode 9, an electrode plug 7 connected through wire rod 10 to the electrode 9 and fixed on a side wall of the intake manifold 2, and a high voltage generator 13 which generates a high voltage between the electrode 9 and the intake manifold 2. The intake manifold 2 is secured at its left end to an engine body by means of bolts, and it supports at its upper right end a carburetor 3. Air which is sucked into the inside of the carburetor 3 from an upper portion of said carburetor 3 is introduced, together with the fuel injected from the nozzle of said carburetor 3, into an interior 2*a* of the intake manifold 2, and then the air is supplied to cylinders of the engine through intake valves mounted on the engine body 1. A heating portion 4 is disposed on an under side of the intake manifold 2 and includes an inlet 5 and an outlet 6 so that, for example, cooling water for the engine or a part of the exhaust gas from the engine is introduced into the heating portion through the inlet 5 and is discharged through the outlet 6 after sufficiently heating the bottom surface of the intake manifold 2. A series of fins 4*a* are formed on the heating portion 4 to aid in increasing the heat transfer coefficient, thus the heat of the cooling water or the heat of the exhaust gas is sufficiently transferred to the intake manifold 2 while the cooling water or a part of the exhaust gas passes through the heating portion 4. The electrode plug 7 is mounted on a through-hole formed on a side wall of the intake manifold 2. The electrode plug 7 comprises a wire rod 10 made of a good conductor, at the one end of which the electrode 9 is carried and at the other end of which a terminal 8 is formed, and an insulator 11 surrounding the wire rod 10. An increased diameter portion having a screw thread 12 on an outer surface thereof is formed at the center of the wire rod 10. The screw thread 12 of the increased diameter portion is engaged with a screw thread formed on an inner surface of the through-hole of the intake manifold 2, thus the electrode plug 7 is rigidly fixed to the intake manifold 2. An earth terminal 17 is attached by a bolt 19 to the intake manifold 2 downward of the electrode plug 7. The terminal 8 of the electrode plug 7 and the earth terminal 17 are connected with the high voltage generator 13 by means of a wire 16 and a wire 18, respectively. The high voltage generator 13 is connected with a battery through a switch 14 which is associated with the ignition switch for the engine 1 so that when the ignition switch is turned to the ON position, the switch 14 also turns to ON and thus a high voltage is applied between the electrode 9 and an inner wall of the intake manifold 2.

Figure 3:
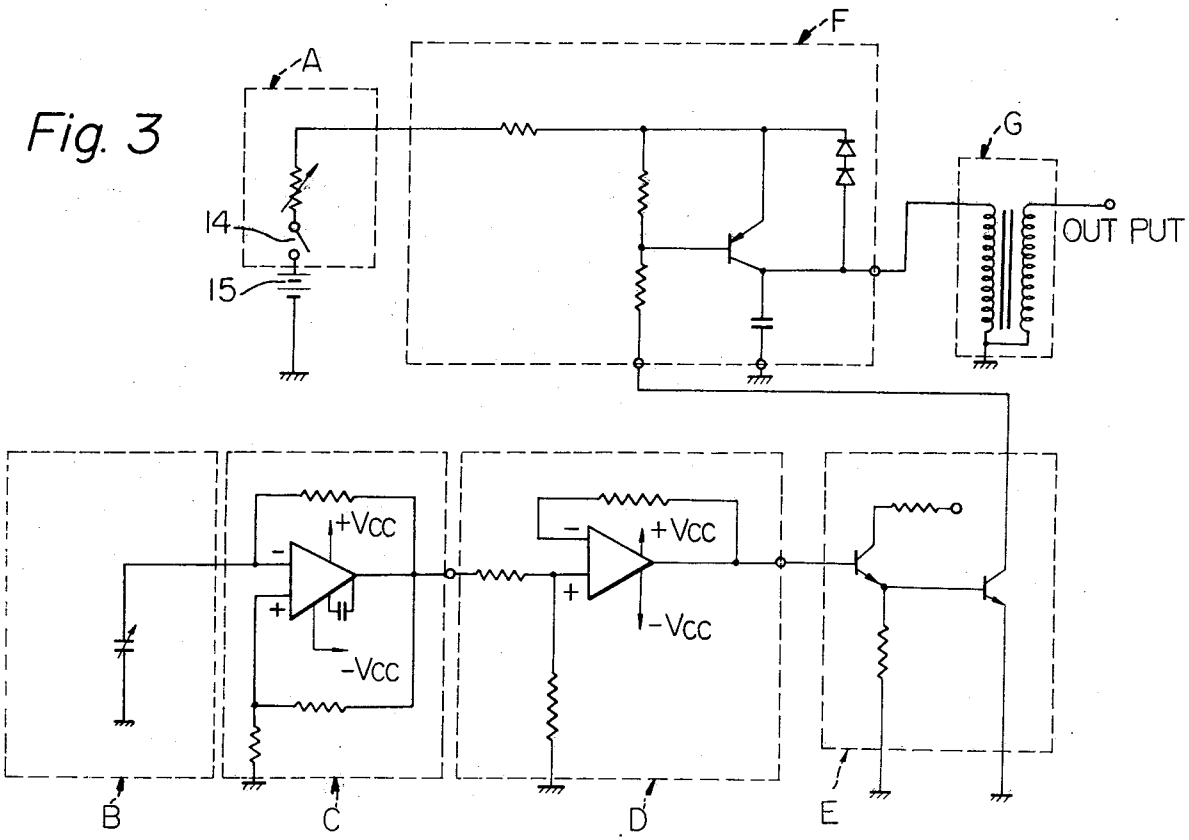
FIG. 3 is a block diagram of a circuit of a high voltage generator.

Referring to FIG. 3, a voltage regulating circuit for regulating an output voltage is designated by reference A, a variable frequency generating circuit for generating a required frequency is formed by both a frequency regulating circuit designated by reference B for regulating a frequency of the output voltage and an oscillator, designated by reference C. A reference D designates a buffer circuit which is provided for preventing the large variation in the power consumed in a power amplifier designated by reference E from influencing the frequency generated by the oscillator C. This amplifier E serves for supplying sufficient power to a switching circuit designated by reference F. This switching circuit F is provided for applying current flow to a primary winding of a coil (or a transformer) designated by reference G, or for interrupting the current flow, and thus a current applied to the coil G is made ON or OFF in accordance with the number of the frequency of a signal transmitted to the switching circuit F from the power amplifier E. The current applied to the coil G is regulated by the voltage regulating circuit A, therefore a voltage excited in a secondary winding of the coil G is also regulated to the corresponding required value. The reference G designates a coil or a transformer which is selected so that the ratio of the secondary winding to the primary winding is such that when a voltage applied to the primary winding is alternately made ON or OFF a high voltage is obtained on the secondary winding. At this time the frequency obtained on the secondary winding is controlled by both the frequency regulating circuit B and the oscillator C through the power amplifier E. It is preferable that the voltage regulating circuit A as well as the frequency regulating circuit B are provided in such a manner that these are controlled in accordance with the operating conditions of an engine, thereby a desirable frequency and a desirable voltage are obtained on the output terminal of the coil or the transformer G by the circuit shown in FIG. 3.

Figure 2:
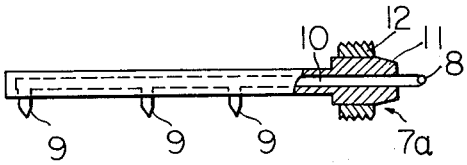
FIG.2 is a sectional side elevation of another preferred embodiment of a wire rod carrying a plurality of electrodes.

Referring to FIG. 2, in a case where a volumetric dimension of the intake manifold 2 is relatively large, the arrangement of electrode plug 7 carrying only one electrode 9 in the intake manifold 2, as shown in FIG. 1, permits a desirable electric field to be formed over only narrow area of the interior of the intake manifold 2. In a case such as this, the arrangement of one electrode plug 7*a* carrying a plurality of electrodes 9 in the intake manifold 2, as shown in FIG. 2, permits a desirable intensive electric field to be formed over the wide extent of the interior of the intake manifold 2. This arrangement of said one electrode plug 7 or said one electrode plug 7*a* may be replaced by another arrangement with a plurality of the electrode plugs 7 carrying only one electrode 9 or by a further arrangement of a plurality of the electrode plugs 7*a* carrying a plurality of electrodes 9, respectively.

When an automobile is driven, the ignition switch is first turned ON, and thus the switch 14 of the high voltage generating circuit 13 is associated with the ignition switch as described hereinbefore and also turns ON, and simultaneously a voltage is applied to the high voltage generating circuit 13 by the battery 15 and generates a high voltage. The positive voltage of this high voltage at the output terminal is applied to the electrode 9 by way of the wire 16, the terminal 8 and the wire rod 10, while the negative voltage of this high voltage is applied to the entirety of the intake manifold 2 by way of the wire 18 and the earth terminal 17, and thus high voltage occurs between the electrode 9 and the intake manifold 2. This high voltage has a frequency selected from a range between 50 to 5,000 Herz and has a selected value between 4,000 to 20,000 Volts. According to FIG. 1 the positive voltage is applied to the electrode 9 and the negative voltage is applied to the entirety of the intake manifold 2. However the negative voltage may be applied to the electrode 9 and the positive voltage may be applied to the entirety of the intake manifold 2, since the results are the same in both cases. It is true that a voltage applied between the electrode 9 and the intake manifold 2 should preferably be as high as possible, however when the voltage applied to the electrode 9 and the intake manifold 2 is increased to the extent where a discharge is caused, there is the danger that fuel existing in the interior 2*a* of the intake manifold 2 will catch fire due to the discharge. Thus the voltage applied between the electrode 9 and the intake manifold 2 should be the highest possible value before discharge occurs. As shown in FIG. 3, the high voltage generator 13 includes both the frequency regulating circuit B and the voltage regulating circuit A. Therefore, the frequency and the voltage applied between the electrode 9 and the intake manifold 2 may be automatically controlled at the desirable value for promoting vaporization in accordance with the operating conditions of the engine or the condition of warming up of the engine. In a case where the volumetric dimension of the intake manifold 2 is relatively large, as described hereinbefore, the electrode plug 7*a*(shown in FIG. 2) or a plurality of the electrode plugs 7 are arranged in the interior of the intake manifold 2. A part of the fuel introduced into the interior 2*a* of the intake manifold 2 from the carburetor 3 after the start of the engine 1 has already vaporized to form a mixture, a part of the remaining fuel is floated in said mixture as fuel droplets and the rest of the remaining fuel impinges the heating portion 4 as fuel droplets, and then the impinged fuel droplets are partially vaporized while the rest of the droplets flow along an inner wall of the intake manifold 2 in the form of liquid fuel. In a case where the aforementioned high voltage is applied between the electrode 9 and the intake manifold 2, the floating droplets in the intake manifold 2 are vaporized sooner compared to a case where high voltage is not applied between said electrode 9 and said intake manifold 2 and fuel flowing along the inner wall of the intake manifold 2 after impinging on the heating portion 4 receives a great amount of heat from the heating portion 4, and thus vaporization of the fuel is promoted.

Consequently, vaporization of the fuel is promoted compared with a case where high voltage is not applied, thus the fuel sufficiently vaporized by the high voltage is supplied into the cylinder of the engine 1. The result is an improvement in starting engines more easily. Further, as the combustion of the fuel is improved by the sufficient vaporization of the fuel, a smooth operation of the engine can be obtained after starting the engine. Further, the richness of the mixture which is caused by using a choke mechanism is avoided, and the result is that a mixture having the same air/fuel ratio as that of the mixture during the ordinary operating conditions of the engine, is supplied to the engine. Thus, an appropriate combustion of the mixture can be obtained in the engine, so that the harmful component in the exhaust gas is reduced. Consequently an anti-pollution factor is attained. According to the present invention, it will be understood that the following various effects are advantageously provided.

i. An engine provided with the vaporization promoting apparatus of the present invention is easily manufactured with no substantial change in the construction of the conventional engine.

ii. As the high voltage is only applied between the electrode and the intake manifold, only a little electric power is consumed;

iii. As soon as the engine is started, the vaporization of fuel is promoted and thus the engine is easily started especially in winter or while the engine is cold;

iv. Smooth operation of the engine is obtained by the sufficient vaporization of the fuel after the start of the engine, and;

v. A harmful component in the exhaust gas is reduced by combustion.

What is claimed is:

1. An apparatus for promoting vaporization of liquid fuel in an internal combustion engine comprising:

an internal combustion engine having an intake manifold that includes a substantially vertical inlet portion turning sharply to a portion having an approximately level bottom surface where fuel tends to be condensed in a liquid film, a downdraft carburetor mounted on the intake manifold directly above the bottom surface for providing fuel and air mixture to the combustion chambers of the engine, at least one electrode disposed in the intake manifold of the internal combustion engine directly beneath the inlet section at a predetermined height above the bottom surface of the intake manifold, a conductive wire rod carrying said electrode at one end, insulating means surrounding the wire rod for attaching the rod to the intake manifold, a high voltage generator having one output terminal which is connected with the other end of said wire rod and another output terminal which is directly connected with the intake manifold, said high voltage generator forming an intensive electric field between said electrode and the interior of the intake manifold in the vicinity of said electrode for promoting vaporization of both the liquid fuel which floats as droplets in the fuel/air mixture passing through the intake manifold and the condensed film of liquid fuel that flows along the bottom surface of said intake manifold, a heating portion disposed on the underside of said bottom surface of the intake manifold, and means for transferring heat from said heating portion to the film of liquid fuel that flows along said bottom surface to enhance the vaporization of the fuel by the high voltage electrode.

2. An apparatus as recited in claim 1 comprising a plurality of electrodes disposed in the intake manifold, said plurality of electrodes being spaced along the length of said conductive wire rod member parallel to the bottom surface of the intake manifold to effectively vaporize the film of liquid fuel flowing along said bottom surface.

3. An apparatus as recited in claim 1 comprising a plurality of electrodes disposed in the intake manifold in spaced relation beneath the inlet portion and at approximately equal height above the bottom surface of the intake manifold and at least one additional conductive wire rod member carrying at one end at least one electrode of said plurality of electrodes, said additional wire rod being fixed to the intake manifold through an insulator, the other end of said additional wire rod being connected to the one terminal of said high voltage generator.

4. An apparatus as recited in claim 1 wherein said high voltage generator comprises an electric power source, a voltage regulating circuit connected to said power source for preventing discharge between the electrode and the intake manifold, a frequency regulating circuit, an oscillator connected to said frequency regulating circuit for generating a frequency controlled by the frequency regulating circuit in accordance with operating conditions of the engine, a buffer circuit connected to the output of said oscillator, a power amplifier connected to said buffer circuit, a switching circuit connected to both said voltage regulating circuit and the output of said power amplifier, and an inductive transformer element connected to said switching circuit, the output of said transformer element having a voltage and frequency determined by said voltage and frequency regulating circuits.

5. An apparatus as recited in claim 4, wherein the frequency regulating circuit of said high voltage generator controls a frequency selected from a range between 50 to 5,000 Herz, and wherein the voltage regulating circuit controls said high voltage selected from a value between 4,000 to 20,000 volts.

* * * * *